US006519962B1

(12) United States Patent
Schuetter

(10) Patent No.: US 6,519,962 B1
(45) Date of Patent: Feb. 18, 2003

(54) REFRIGERATED MERCHANDISER ANGULAR AIR GUIDE VANES

(75) Inventor: Michael J. Schuetter, South Bend, IN (US)

(73) Assignee: Carrier Corporation, Syracuse, NY (US)

( * ) Notice: Subject to any disclaimer, the term of this patent is extended or adjusted under 35 U.S.C. 154(b) by 0 days.

(21) Appl. No.: 10/185,222

(22) Filed: Jun. 27, 2002

(51) Int. Cl.[7] ..... A47F 3/04
(52) U.S. Cl. ..... 62/255; 62/256; 454/193
(58) Field of Search ..... 62/256, 255; 454/193

(56) References Cited

U.S. PATENT DOCUMENTS

| | | | | | |
|---|---|---|---|---|---|
| 3,584,467 | A | * | 6/1971 | Barroero | 62/252 |
| 5,502,979 | A | * | 4/1996 | Renard | 62/256 |
| 5,755,108 | A | | 5/1998 | Ibrahim et al. | |
| 5,761,922 | A | * | 6/1998 | Tamai et al. | 62/256 |
| 5,870,903 | A | * | 2/1999 | Meyers et al. | 62/255 |
| 5,946,934 | A | * | 9/1999 | Kim et al. | 62/408 |
| 5,974,818 | A | * | 11/1999 | Topper et al. | 62/255 |
| 6,041,616 | A | * | 3/2000 | Jeong | 62/256 |
| 6,128,912 | A | * | 10/2000 | Wetzel | 62/256 |
| 6,145,327 | A | * | 11/2000 | Navarro | 62/255 |
| 6,379,240 | B2 | * | 4/2002 | Livchak et al. | 454/193 |
| 6,381,976 | B1 | * | 5/2002 | Kempiak et al. | 62/255 |

OTHER PUBLICATIONS

Article from Nov., 2001 AMCA International's Supplement to ASHRAE Journal.

Patent application Ser. No. 09/844,939 filed Apr. 27, 2001 entitled Wadge Shaped Refrigerated Display Case.

* cited by examiner

*Primary Examiner*—William E. Tapolcai
*Assistant Examiner*—Mohammad M. Ali
(74) *Attorney, Agent, or Firm*—Carlson, Gaskey & Olds

(57) ABSTRACT

A refrigeration system comprises a display case having a bottom, a top, a first side, a second side, and a viewing area, all of which define a display space. A refrigeration coil cools the display case. At least one fan is adjacent the coil and propels cool air through the display space. A vertical channel communicates with the fan and orifices along the channel distribute air horizontally across the display space. At least one surface extends across the display space and directs air along a different horizontal path.

12 Claims, 3 Drawing Sheets

REFRIGERATED MERCHANDISER ANGULAR AIR GUIDE VANES

BACKGROUND OF THE INVENTION

This invention relates to a refrigerated display case having air guide vanes to direct air within the display case.

Typically, a refrigerated display case includes a cold air discharge at one end of the case that blows cold air from the back of the case to the front of the case and over products contained therein. In addition, there is a diffuser at the top of the display case near the front that discharges cold air across the front opening of the display case. The diffuser includes a plurality of guide structures, known as straws, disposed to direct the flow of air perpendicular down the front opening of the display case. Cold air then flows to a warm air return at the bottom of the case, flowing back through a cooling circuit and out again through the cold air discharge. Typically, the display case is of a standard rectangular shape and the cold air discharge and the warm air return at opposite ends of the viewing area are of substantially the same length.

Some display cases are shaped to provide a pleasing appearance and to separate different product types by being positioned around comers. Historically, an outside comer display case was not refrigerated and used only to provide the appearance of a continuous refrigerated display case. Because the outside display case was not refrigerated, only products not requiring refrigeration were displayed in the outside comer unit.

It would be desirable to provide the option of refrigerated outside comer units, which presents a design challenge. The geometry of an outside comer display case limits the length of the cold air discharge such that the cold air discharge is substantially shorter in length than the warm air return. That is, a comer unit has an inner back that tends to be smaller than its outer front. The cold air discharge associated with the smaller end thus directs flow only over a limited portion of the case. This creates uneven cooling of the products displayed over the display area. The known diffuser tended to direct the flow of cold air straight through the center of the display area, leaving the extreme outer edges of the display area inadequately cooled.

A need therefore exists to distribute cool air across all areas of the display space.

SUMMARY OF THE INVENTION

The invention comprises a refrigeration system having at least one vane extending to distribute air uniformally across the entire display case space. The refrigeration system comprises a display case having a display space, a refrigeration coil for cooling the display space, a fan for directing air into the display space, a vertical channel to move air across the height of the display space, an orifice to direct air along a first horizontal path, and at least one vane extending across the display space to redirect air along the second horizontal path with the second horizontal path being in a direction towards the outer edges of the cases. The invention accordingly permits the uniform distribution of air across the entire display space, permitting cooling air to be directed to areas not adequately covered previously.

The vane may be a planer rectangular and upper structural parts, member extending across the display space. The vane may be connected to the shelf and may extend perpendicularly from the shelf and the structural parts. Preferably, multiple vanes may be connected to each shelf or parts to distribute uniformally air across the entire display space.

The refrigeration system may have an upper horizontal channel and may be shaped like a wedge to fit in a corner. The refrigeration system may have an outlet at its top distributing air downward into a warm air return, thereby creating an air curtain across an open display area. A vane may also be provided in the upper horizontal channel to redirect the flow of air across the upper horizontal channel.

In this manner, the refrigeration system distributes air across a display space along a first horizontal path. Based upon a determination of the desired distribution across the display case, air is redirected along a second horizontal path by vanes. The second horizontal path is more in a direction towards outer edges of the display case. The redirection of air occurs across the display space to redistribute air to all regions of the space.

BRIEF DESCRIPTION OF THE DRAWINGS

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
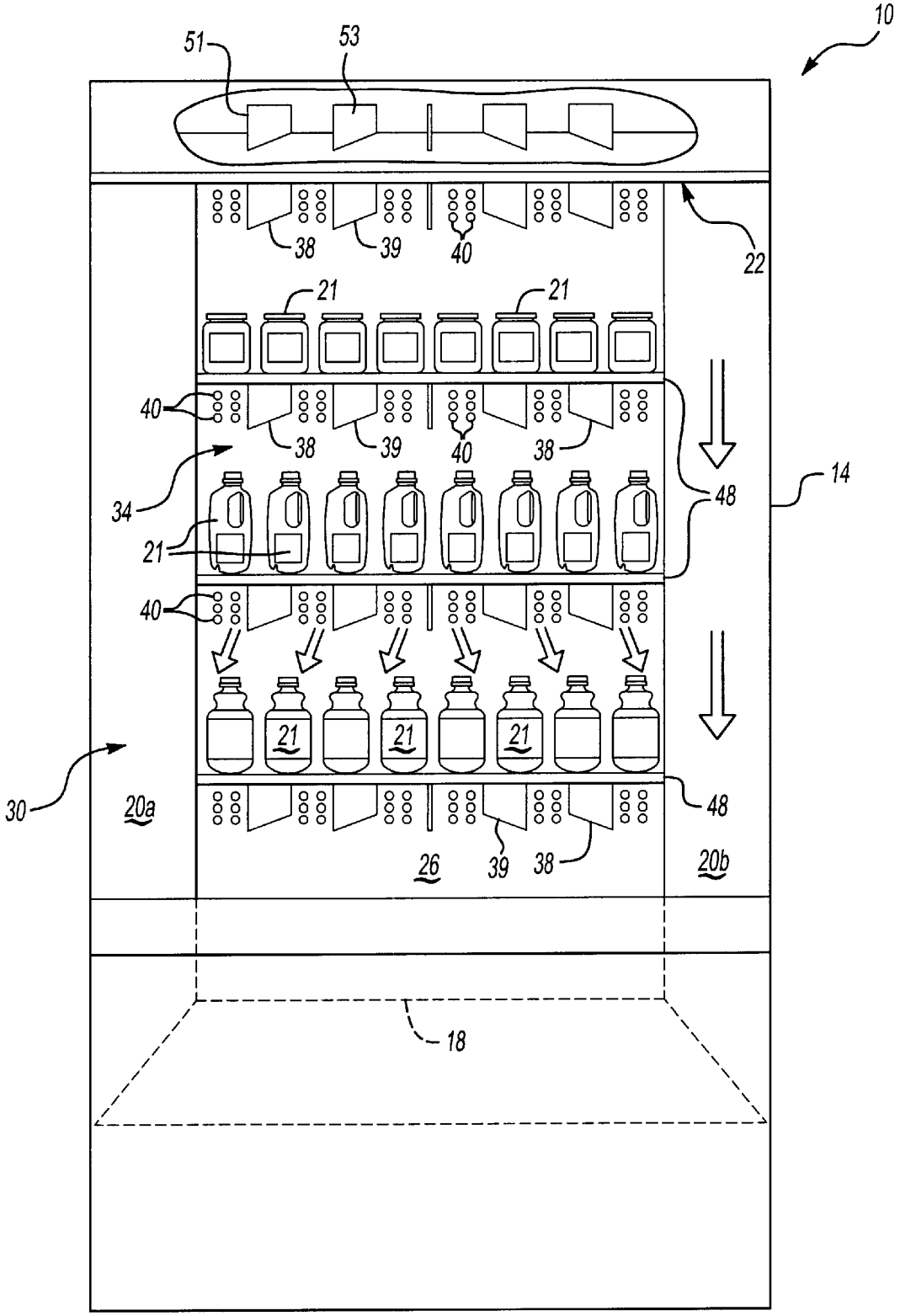
FIG. 1 illustrates a front view of the inventive refrigeration system.

FIG. 1 illustrates a front view of the inventive refrigeration system 10. Refrigeration system 10 comprises display case 14, which has a display space 34 comprised of interior top 22, bottom 18, first side 20A, second side 20B, back 26 and viewing area 30. Viewing area 30 may be open or enclosed as known. Refrigerated goods 21 may be stored on shelves 48, which are connected through a known manner to display case 14. Several orifices 40 blow cool air from back 26 into display space 34. As shown in FIG. 1, these orifices may comprise multiple holes in the back of display case 14 that direct cool air towards the front of display case 14. The air cools display space 34 and refrigerated goods 21 contained therein. To facilitate cooling of display space 34, refrigeration system 10 is provided with surface vanes 38, 39 that alters the direction of air flow from the orifices 40. In this way, air may be distributed more evenly across display space 34.

Figure 2:
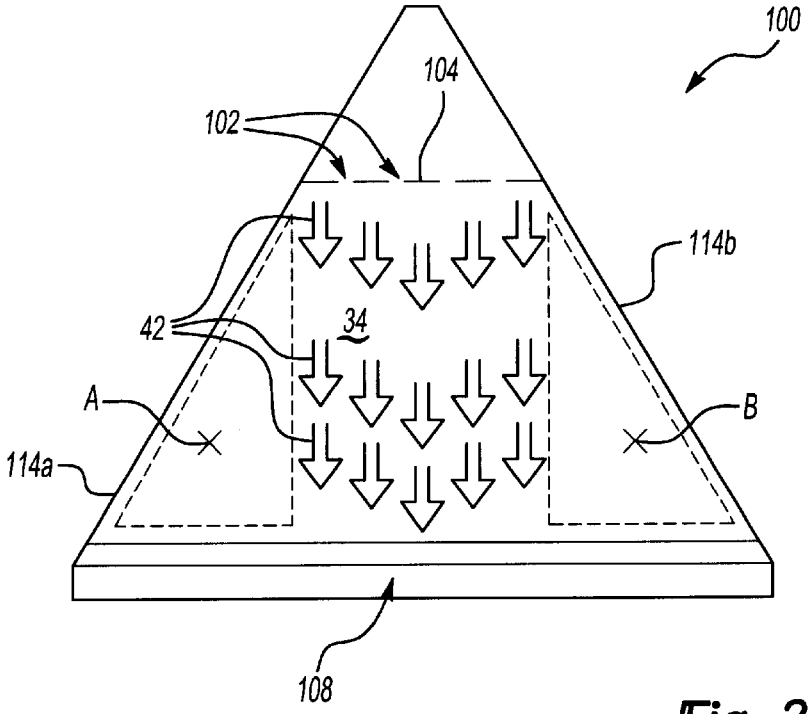
Fig-2 PRIOR ART
FIG. 2 illustrates the air flow for a prior art wedge shape refrigeration system.

For example, FIG. 2 illustrates the distribution of air of a prior art comer refrigeration system 100. The inventive system has the same basic structure, including back wall 104 having orifices 102 that direct air along a first horizontal path 42 from back 104 to front 108. Refrigeration system 100 also has first side 114A and second side 114B. Due to the wedge shaped design of refrigeration system 100, the transmission of air along horizontal path 42 potentially results in dead spots A and B where cool air is not circulated. Refrigerated goods 21 sitting in these areas will be cooled less effectively than those sitting on shelves along horizontal path 42.

Figure 3:
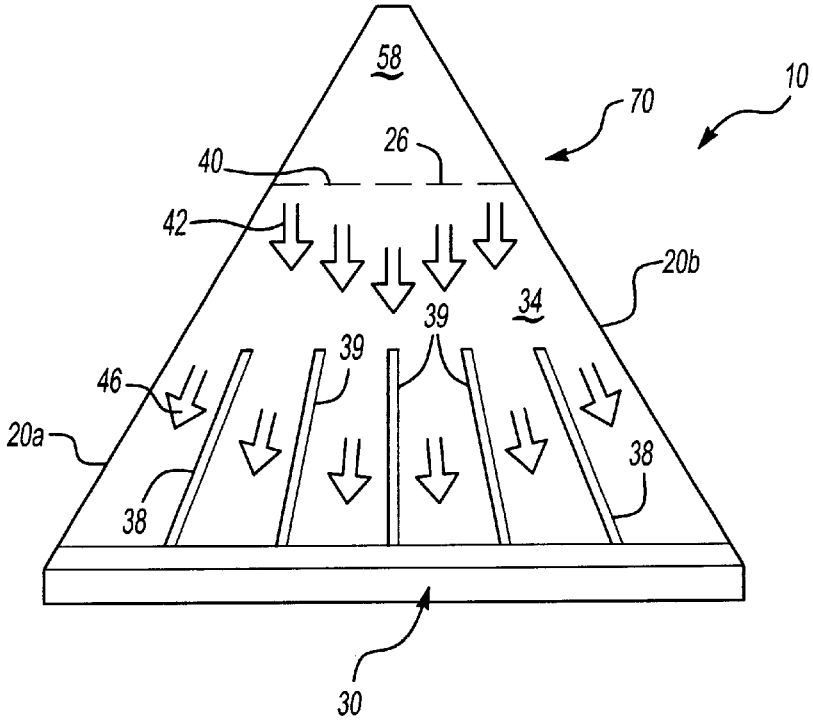
FIG. 3 illustrates the air flow of the inventive refrigeration system.

FIG. 3 illustrates a top view of the inventive design of refrigeration system 10 looking downwardly with a shelf removed. As shown, refrigeration system 10 has vanes 38 within displace space 34 to alter the direction of air flow. Specifically, air from vertical channel 58 is distributed out of orifices 40 of back 26 along first horizontal path 42. Air then encounters at least vanes 38 to redirect air along different paths 46. The vanes 38 maybe spaced from orifices 40. As can be appreciated from this figure, there are laterally outer vanes 38 which extend at a greater angle relative to the direction 42 than laterally more central vanes 39. The several vanes 38, 39 in combination direct the flow to the laterally outermost regents of the display case. Accordingly, air may be transmitted from back 26 to front 30 to cover the former dead spots and distribute air more uniformally across display space 34 from back 26 to front 30. Refrigerated product 21 is then cooled uniformally within display space 34. Multiple surfaces may then be provided to distribute horizontally and radially air from vertical channel 58 through orifices 40 of back 26 to front 30.

Figure 4:
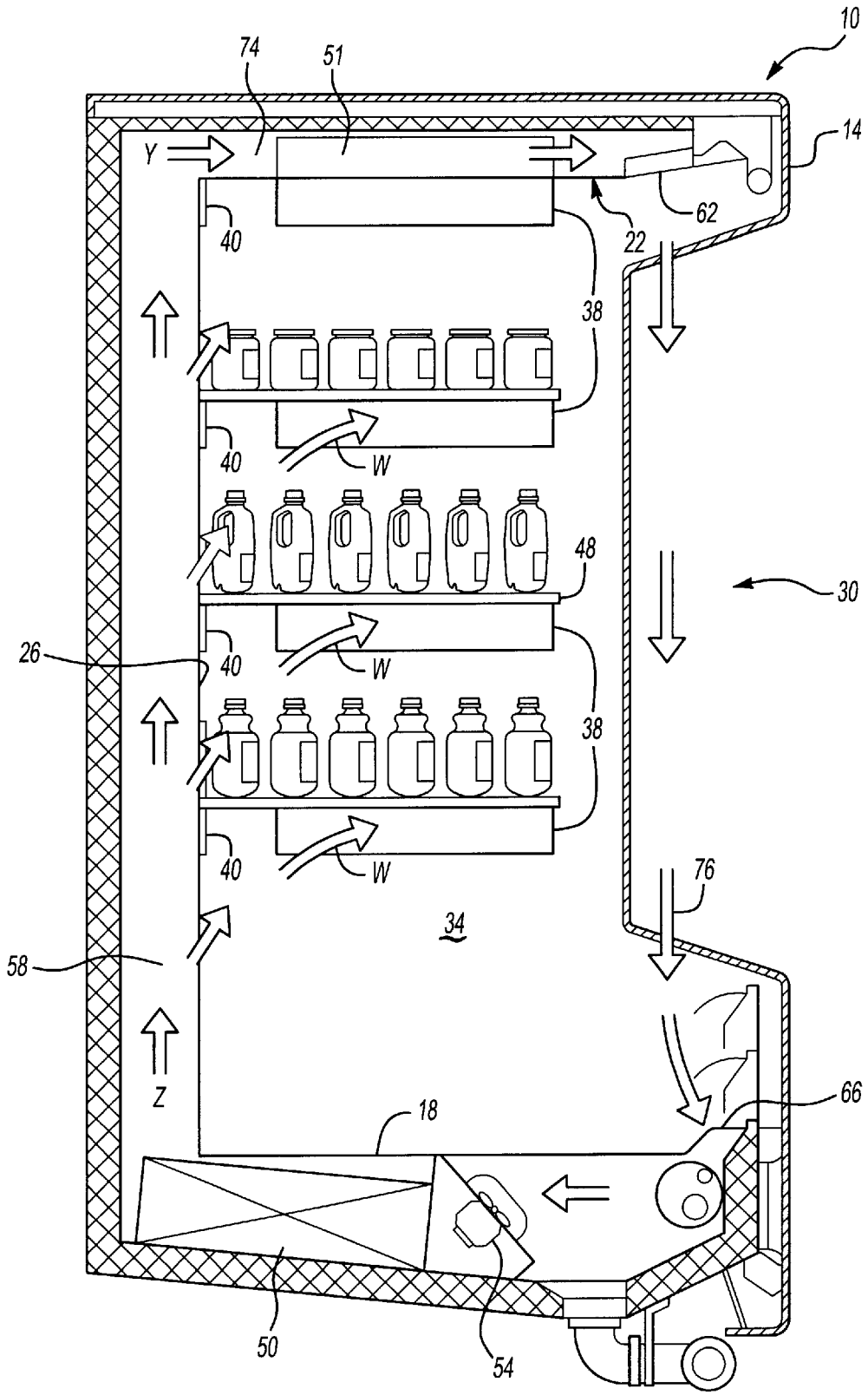
FIG. 4 illustrates a side view of the inventive refrigeration system.

FIG. 4 shows a cross-section of refrigeration system 10. As shown, refrigeration system 10 maybe of the kind to distribute air across viewing area 30 such as to create an air curtain 76 across area 30. Refrigeration system 10 may have outlet 62 that blows air downwardly toward inlet 66, a warm air return. Air received by warm air return is driven by fan 54 across refrigeration coil 50 to cool the air. The air is driven up vertical channel 58 along back 26 of refrigeration display case 14. At various points of back 26 are orifices 40 that communicate air from vertical channel 58 in a diagonal direction relative to bottom 18 into display space 34. As shown in FIGS. 3 and 4, air is redirected by surfaces 38 to spread air across the front of display case 14 in a uniform fashion. Additionally, horizontal channel 74 may direct air from vertical channel 58 to outlet 62, thus recycling air within refrigeration system 10. Plural vanes 51 may also redistribute air across horizontal channel 74 in the same manner as shown in FIG. 3. As shown in FIG. 1, surface 51 and surface 53 may be arranged to direct air from vertical channel 58 laterally outwardly and horizontally across horizontal channel 74. Refrigeration system 10 may be of a wedge shape 70 as shown in FIG. 3.

The aforementioned description is exemplary rather that limiting. Many modifications and variations of the present invention are possible in light of the above teachings. The preferred embodiments of this invention have been disclosed. However, one of ordinary skill in the art would recognize that certain modifications would come within the scope of this invention. Hence, within the scope of the appended claims, the invention may be practiced otherwise than as specifically described. For this reason the following claims should be studied to determine the true scope and content of this invention.

What is claimed is:

1. A refrigeration system comprising;

a display case having a bottom, a top, laterally spaced first and second sides, and a viewing area, defining a display space;

a cooling element for cooling air within said display space;

at least one fan adjacent for propelling air across said cooling element;

at least one vertical channel in communication with said at least one fan directing said air along a vertical path;

at least one orifice in communication with said vertical channel directing said air along a first horizontal path; and at least one vane extending across said display space and operatively connected to said display case, directing said air along a second horizontal path with a greater lateral component than said first horizontal path.

2. The refrigeration system of claim 1 wherein there are a plurality of said vanes.

3. The refrigeration system of claim 1 wherein said plurality of vanes include vanes at selected angles such that laterally outermost ones of said vanes have a greater lateral component than laterally inner ones of said vanes.

4. The refrigeration system of claim 1 including an outlet at said top of said display case in communication with said vertical channel directing said air to an inlet at said bottom of said display case in communication with said refrigeration coil.

5. The refrigeration system of claim 1 wherein said display space is wedge-shaped.

6. The refrigeration system of claim 1 including at least one shelf within said display space wherein said vane is mounted beneath said at least one shelf.

7. The refrigeration system of claim 6 wherein there are a plurality of said vanes beneath said shelf.

8. The refrigeration system of claim 1 wherein said vertical channel extends to an uppermost horizontal channel with said vane being received within said uppermost horizontal channel.

9. The refrigeration system of claim 8 wherein a lower wall defining said uppermost horizontal channel has vanes on both vertical sides, with one set of said vanes being within said uppermost horizontal channel, and a second set of said vanes extending downwardly from said lower wall into said display space.

10. A refrigeration system comprising:

a display case having a bottom, a top, laterally spaced first and second sides, and a viewing area, defining a wedge-shaped space;

a refrigeration coil in communication with said display case for cooling said display space;

at least one fan adjacent for driving air across said coil to said display space;

at least one vertical channel in communication with said at least one fan for directing said air along a vertical path;

plural vertically spaced shelves within said display space;

a plurality of orifices associated with a vertical location beneath each of said shelves; and a plurality of vanes extending downwardly from each of said shelves to direct air flow from said orifices in laterally outward directions.

11. The refrigeration system of claim 10 wherein said at least one surface comprises at least two surfaces wherein one of said surfaces is attached to one side of said top and one of said surfaces is attached to the other side.

12. The refrigeration system of claim 11 wherein said at least one surface comprises a plurality of surfaces extending horizontally and radially from said vertical channel.

* * * * *

UNITED STATES PATENT AND TRADEMARK OFFICE

CERTIFICATE OF CORRECTION

PATENT NO. : 6,519,962 B1
DATED : February 18, 2003
INVENTOR(S) : Schuetter

It is certified that error appears in the above-identified patent and that said Letters Patent is hereby corrected as shown below:

Column 3,
Line 4, “at least vanes” should be -- at least one vane --.

Column 4,
Line 10, “1” should be -- 2 --.
Lines 55 and 59, “surface” should be -- vane -- and “surfaces” should be -- vanes --.
Lines 56 and 57, “surfaces” should be -- vanes --.

Signed and Sealed this

Twenty-ninth Day of July, 2003

JAMES E. ROGAN
*Director of the United States Patent and Trademark Office*